US007733286B2

(12) United States Patent
Chen et al.

(10) Patent No.: US 7,733,286 B2
(45) Date of Patent: Jun. 8, 2010

(54) WIDEBAND PRINTED DIPOLE ANTENNA FOR WIRELESS APPLICATIONS

(75) Inventors: Wen-Shan Chen, Kaohsiung (TW); Yen-Hao Yu, Taipei (TW)

(73) Assignee: Southern Taiwan University, Tainan County (TW)

( * ) Notice: Subject to any disclaimer, the term of this patent is extended or adjusted under 35 U.S.C. 154(b) by 186 days.

(21) Appl. No.: 12/126,960

(22) Filed: May 26, 2008

(65) Prior Publication Data

US 2009/0289867 A1 Nov. 26, 2009

(51) Int. Cl.
*H01Q 9/28* (2006.01)

(52) U.S. Cl. ..... 343/795; 343/793; 343/700 MS

(58) Field of Classification Search ..... 343/700 MS, 343/793, 795, 820
See application file for complete search history.

(56) References Cited

U.S. PATENT DOCUMENTS 4,814,783 A * 3/1989 Shelton et al. ..... 343/795
7,289,065 B2 * 10/2007 Prieto-Burgos et al. ..... 343/700 MS
7,355,559 B2 * 4/2008 Tikhov et al. ..... 343/895
7,429,953 B2 * 9/2008 Buris et al. ..... 343/700 MS

* cited by examiner

*Primary Examiner*—Hoang V Nguyen
(74) *Attorney, Agent, or Firm*—Rosenberg, Klein & Lee

(57) ABSTRACT

In a broadband printed dipole antenna for wireless applications, metal plates of a radiation portion, a feed-in portion and a bandwidth modulation portion are formed on a substrate. Two radiation portions come with a specific shape and have an interval between the two radiation portions. The feed-in portion is composed of two separated long bars and coupled to one of the specific shaped radiation portions. The bandwidth modulation portion is disposed symmetrically adjacent to the feed-in portion, such that the impedance matching can be adjusted to form a broadband dipole antenna for WiMAX applications.

6 Claims, 27 Drawing Sheets

X-Y Plane

Y-Z Plane

X-Y Plane

Y-Z Plane

X-Y Plane

Y-Z Plane

X-Y Plane

Y-Z Plane

X-Y Plane

Y-Z Plane

X-Y Plane

Y-Z Plane

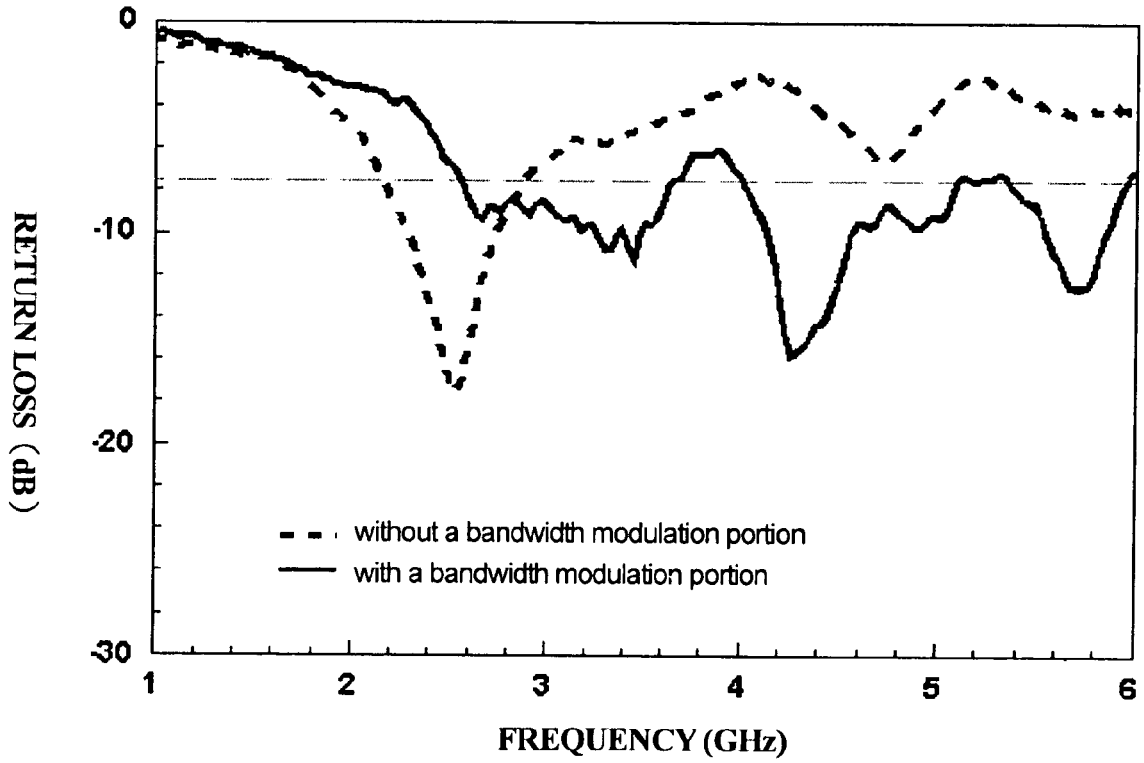
FI.G 27

WIDEBAND PRINTED DIPOLE ANTENNA FOR WIRELESS APPLICATIONS

FIELD OF THE INVENTION

The present invention relates to a wideband printed dipole antenna for wireless applications, and more particularly to a wideband printed dipole antenna having two modulation metal plates disposed between two radiation portions of the antenna and extended to both lateral sides of a feed-in portion symmetrically to serve as a bandwidth modulation portion.

BACKGROUND OF THE INVENTION

Manufacturers and designers have invested tremendously on the research and development of dual-band or tri-band dipole antennas for WiMAX/WLAN, and some of the research results are disclosed in the following patents and patent applications: (1) R.O.C. Pat. No. 1283945 entitled "Dual-band dipole antenna", (2) R.O.C. Pat. Publication No. 200727533 entitled "Planar dipole antenna", (3) R.O.C. Pat. Publication No. 200701556 entitled "Dual-band dipole antenna", (4) R.O.C. Pat. Publication No. 200719532 entitled "Dipole antenna", (5) U.K. Pat. Application No. 0518996.4 entitled "Balanced antenna devices" and (6) U.S. Pat Application No. [2005/0035919A1] of application Ser. No. 10/641,913 entitled "Multi-band printed dipole antenna".

However, the aforementioned patents (1), (2) and (3) achieve their functions by a more complicated structure, a heavier weight and a higher cost, and a more difficult way of integrating a radio frequency circuit system. The aforementioned patents (4), (5) and (6) can be operated by a wideband or dual-band antennas only. On the other hand, a printed structure of the present invention comes with a light weight, a low profile, a low cost and an easy way of integrating a radio frequency circuit system.

SUMMARY OF THE INVENTION

The primary objective of the present invention is to overcome the shortcomings of the prior art by providing a wideband printed dipole antenna for wireless applications. The antenna uses a single feed-in line and a specific shaped metal plate to achieve a 2.13~2.88 GHz single-frequency resonance mode, and then uses a signal source and a grounded feed-in line with a symmetric modulation metal plate for producing a coupling effect among the signals and adjusting the impedance matching, so as to increase the bandwidth and achieve the wideband operations in compliance with the tri-band WiMAX. Further, an L-shaped slit is created in the modulation metal plate, such that the impedance matching of the wideband antenna can meet the requirements for a dual-band operation and cover the bands of 2.4~2.48 GHz and 5.15~5.825 GHz of the WLAN.

The present invention relates to a wideband printed dipole antenna for wireless applications, with a substrate comprising:

a radiation portion, having a first radiator and a second radiator with an interval between the first and second radiator, and the first and second radiators being oval metal plates;

a feed-in portion, in the shape of a long bar with corresponding upper and lower sides, and including a first linear section and a second linear section, and the first linear section being extended from the first radiator towards the second radiator, and the second linear section being extended from the second radiator towards the first radiator, and an interval being formed between the first and second linear sections; and a bandwidth modulation portion, including a first modulation metal plate and a second modulation metal plate, symmetrically and respectively disposed on the upper and lower sides of the feed-in portion.

In the wideband printed dipole antenna for wireless applications, the bandwidth modulation portion includes a first band reject disposed on the first modulation metal plate, and a second band reject disposed on the second modulation metal plate.

The first band reject and the second band reject are installed anti-symmetrically, and the first modulation metal plate and the second modulation metal plate disposed in the bandwidth modulation portion are divided into a first side proximate to the first radiator, a second side proximate to the feed-in portion, and a third side and a fourth side corresponding to the first side, wherein the first band reject disposed at the first modulation metal plate includes an L-shaped slit extended from an opening of the first side towards the third side and with a closed end of the first side disposed in a direction towards the fourth side, and the second band reject is disposed at the second modulation metal plate, and an opening of the third side extended towards the first side includes another L-shaped slit, and with a closed end disposed towards the fourth side.

The wideband printed dipole antenna for wireless applications is printed on a FR-4 board with a relative dielectric constant $\in_r$=4.4 and a loss tangent of 0.0245.

The wideband printed dipole antenna for wireless applications is fed in the feed-in portion with a microstrip of 50 ohms.

The wideband printed dipole antenna for wireless applications includes the first and second modulation metal plates, both in a rectangular shape.

The present invention has the following advantages:

1. The invention is applied to a WiMAX wideband dipole antenna having a volume of 41×15×0.8 mm3 only, and the printed antenna has the super thin, lightweight, easy-to-manufacture advantages. With a simple structure, the antenna of the invention is cost-effective.

2. The invention provides dual-band operations covering the bands of 2.4~2.48 GHz and 5.15~5.825 GHz for WLAN, and has a good radiation and an isotropical radiation field for an easy integration of a radio frequency circuit system.

3. The invention designs the antenna for wideband or dual-band operations, and the cost for filters can be saved if the antenna is used for dual-band operations. The design simply requires a single anti-symmetric slit for preventing suppressed bands, and adjusts the length of the slit to shift two suppressed bands to a high frequency or a low frequency.

BRIEF DESCRIPTION OF THE DRAWINGS

FIG. 9(*b*) shows a 2.5 GHz radiation field on Plane Y-Z of a single-frequency rhombic dipole antenna;

FIG. 21(*b*) shows a graph of the antenna gain versus the frequency of a single-frequency rhombic dipole antenna including a band reject portion on a bandwidth modulation portion at 5.1~5.9 GHz;

FIG. 27 shows a graph of the return loss versus the frequency of a wideband rectangular printed dipole antenna for wireless applications.

DETAILED DESCRIPTION OF THE PREFERRED EMBODIMENTS

Figure 1:
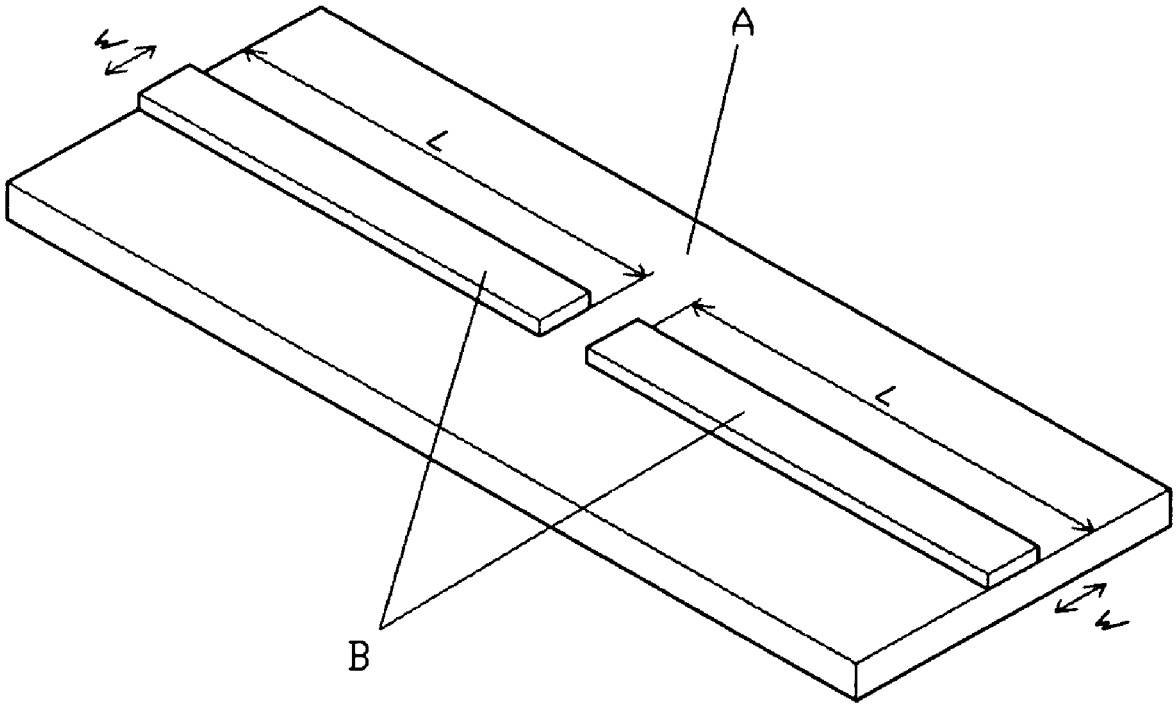
FIG. 1 shows a planar rectangular dipole antenna structure.

Referring to FIG. 1 for a planar rectangular dipole antenna, a symmetric rectangular feed-in line B is formed on a substrate A of a FR-4 board having a relative dielectric constant $\in_r$=4.4, a loss tangent of 0.0245, a thickness of 0.8 mm and an area of 41 mm×15 mm.

Figure 2:
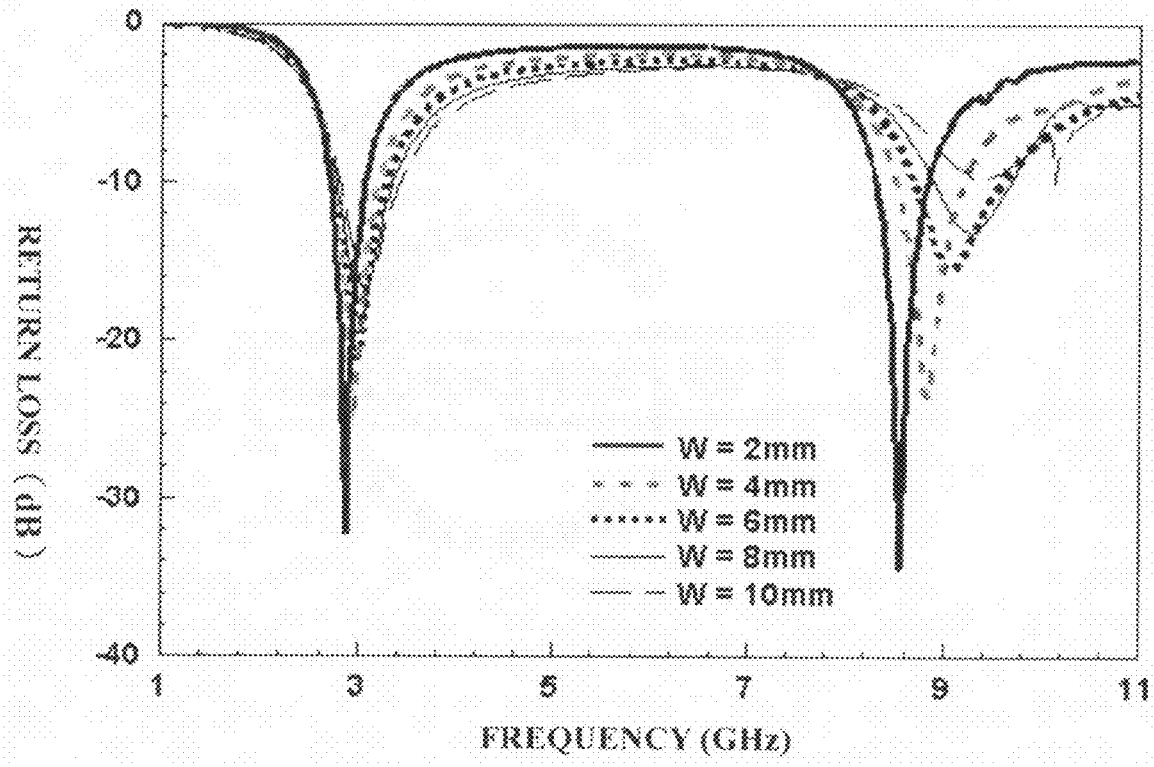
FIG. 2 shows a graph of the width of a rectangular feed-in line of a planar rectangular dipole antenna versus the return loss.

In FIG. 2, the length L and the width W of the rectangular feed-in line B are changed to observe the return loss. If the length L of the rectangular feed-in line B is fixed and the width W is smaller than 10 mm, the antenna features dual operations, and the ratio of high frequency and low frequency is approximately equal to 3.

Figure 3:
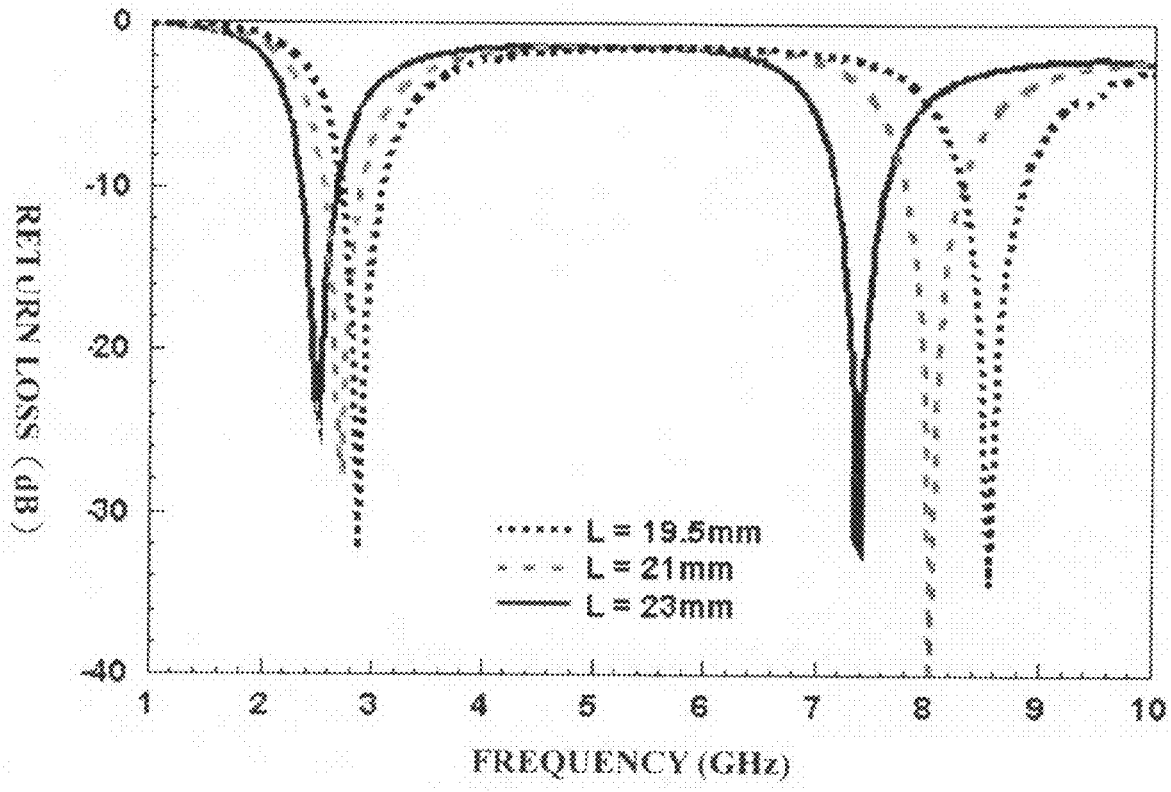
FIG. 3 shows a graph of the length of a rectangular feed-in line of a planar rectangular dipole antenna versus the return loss.

In FIG. 3, the width of the rectangular feed-in line B is fixed and the length is adjusted. The longer the rectangular feed-in line B, the longer is the wavelength and the lower is the operating frequency.

Figure 4:
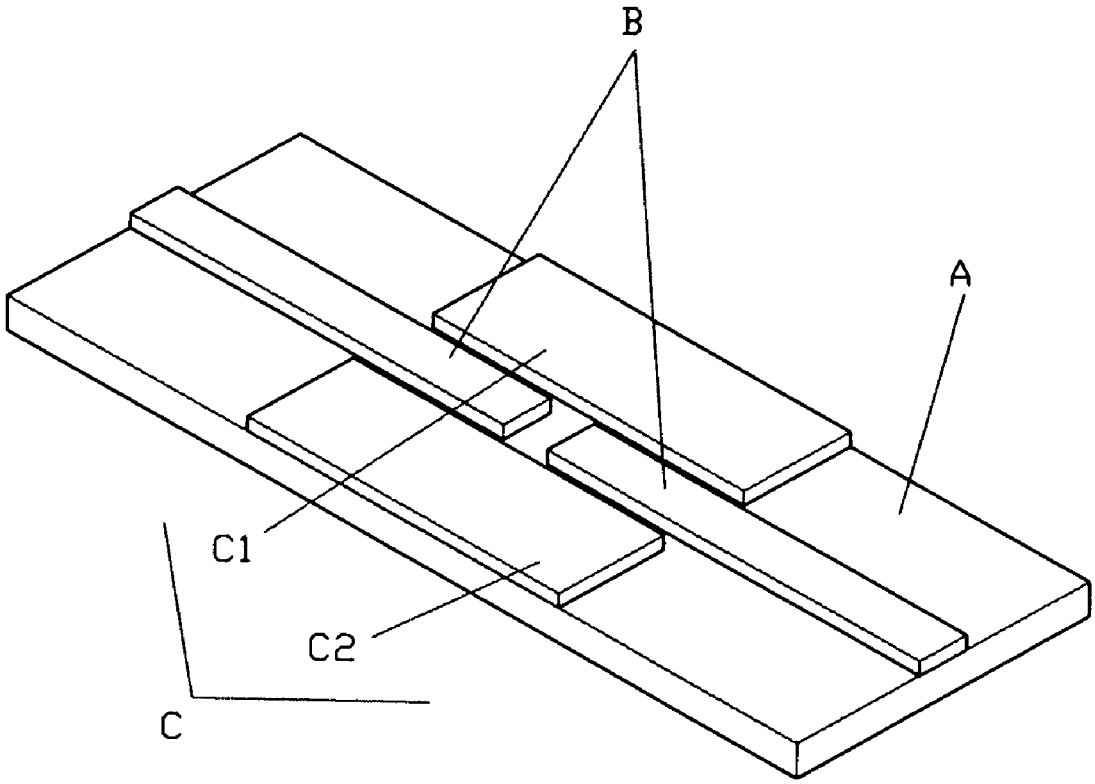
FIG. 4 shows a planar rectangular dipole antenna including a bandwidth modulation portion.

In the planar rectangular dipole antenna, both bands are narrowband, and WiMAX belongs to tri-frequency operations or covers tri-frequency wideband operations. In FIG. 4, a bandwidth modulation portion C is added to the planar rectangular dipole antenna to achieve this requirement. The bandwidth modulation portion C includes a first modulation metal plate C1 and a second modulation metal plate C2, both in a rectangular shape and disposed on upper and lower sides of the rectangular feed-in line B respectively.

Figure 5:
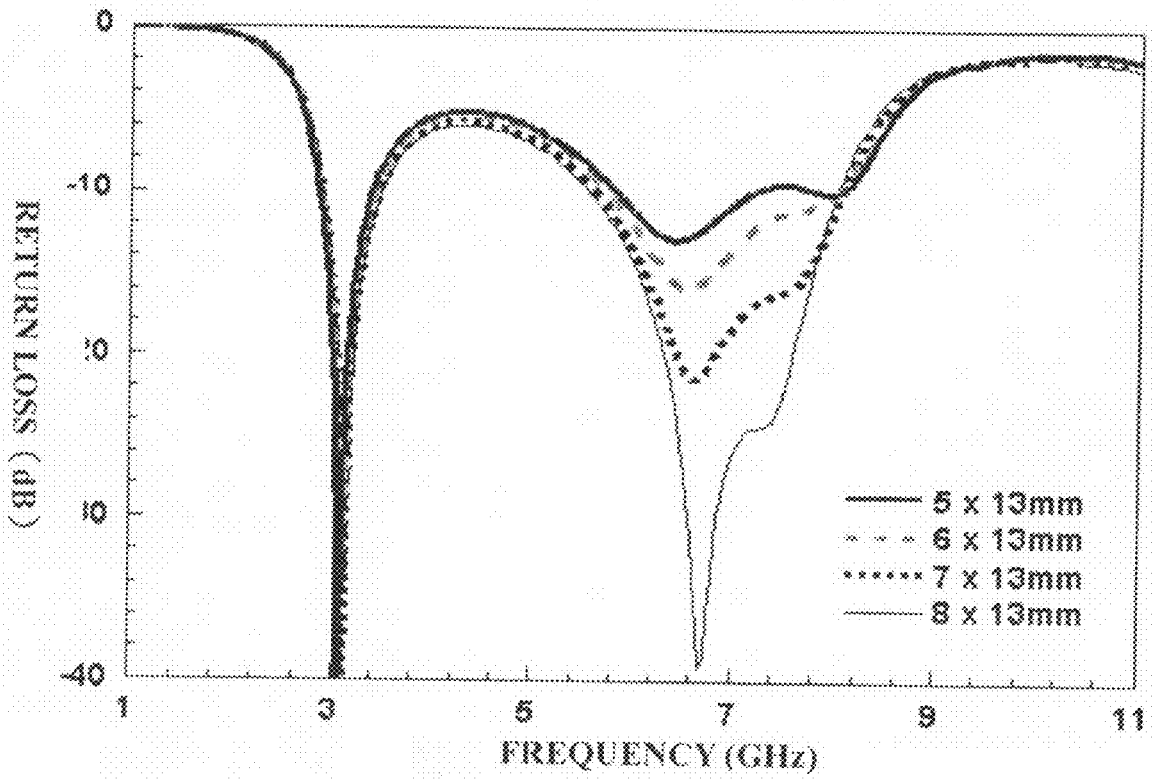
FIG. 5 shows a graph of the width of a planar rectangular dipole antenna including a bandwidth modulation portion versus the return loss.

In FIG. 5, the planar rectangular dipole antenna of the bandwidth modulation portion C is added, and the rectangular feed-in line B comes with a fixed width of 2 mm and a fixed length of 19.5 mm, and then the widths of the first modulation metal plate C1 and the second modulation metal plate C2 are adjusted while maintaining the length fixed. In FIG. 5, the adjusted width will affect the matching of high frequency bands, but not the low frequency bands. Since the mode produced by the bandwidth modulation portion C is integrated with the original dual-frequency portion into a new mode, a change of width will not affect the low frequency bands.

Figure 6:
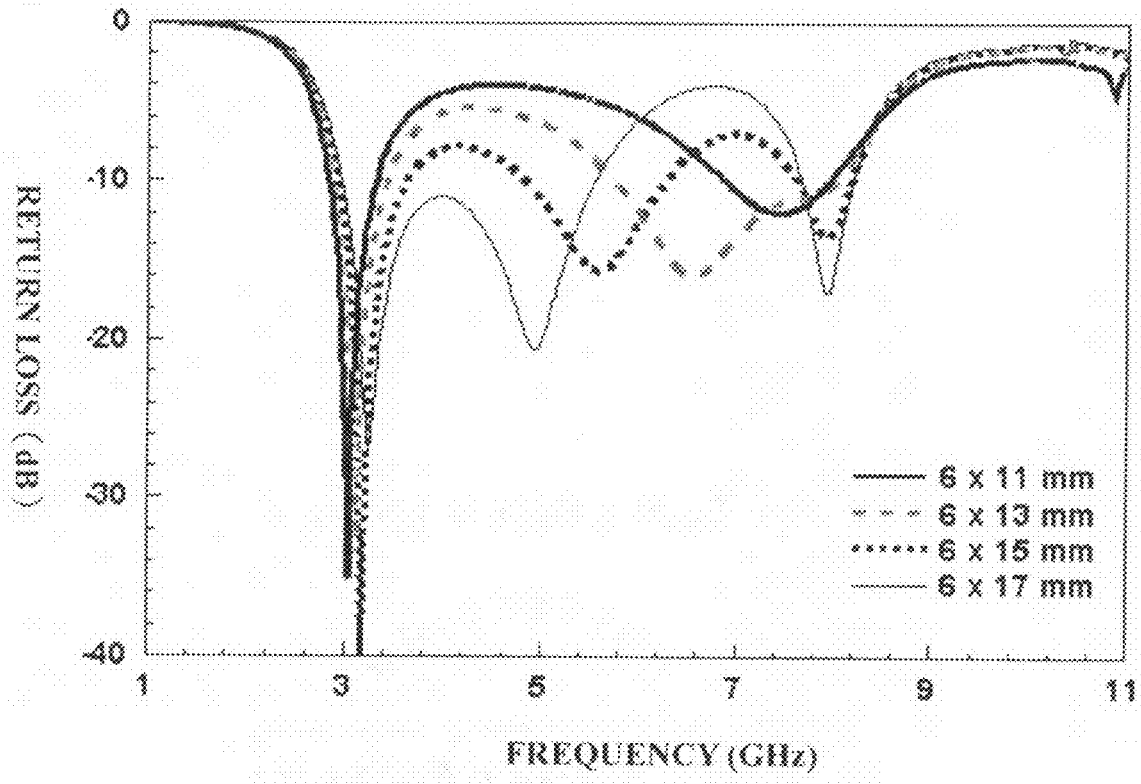
FIG. 6 shows a graph of the length of a planar rectangular dipole antenna including a bandwidth modulation portion versus the return loss.

In FIG. 6, the width W of the first modulation metal plate C1 and the second modulation metal plate C2 of the aforementioned antenna is fixed and the length L is adjusted to observe the impedance matching. We can find out that if the length L of a planar rectangular dipole antenna is smaller than 15 mm, a new produced mode will be integrated with the original high frequency mode to form a new frequency mode. If the length L is equal to 15 mm, the antenna shows tri-frequency operations. If the length L is greater than 15 mm, the mode produced by the bandwidth modulation portion C will be integrated with the original mode to form a new low frequency mode. Such phenomenon gives a big help to the design of antennas, and thus the following embodiments attempt to use radiation portions of various different shapes to achieve the operations in compliance with WiMAX bands.

Figure 7:
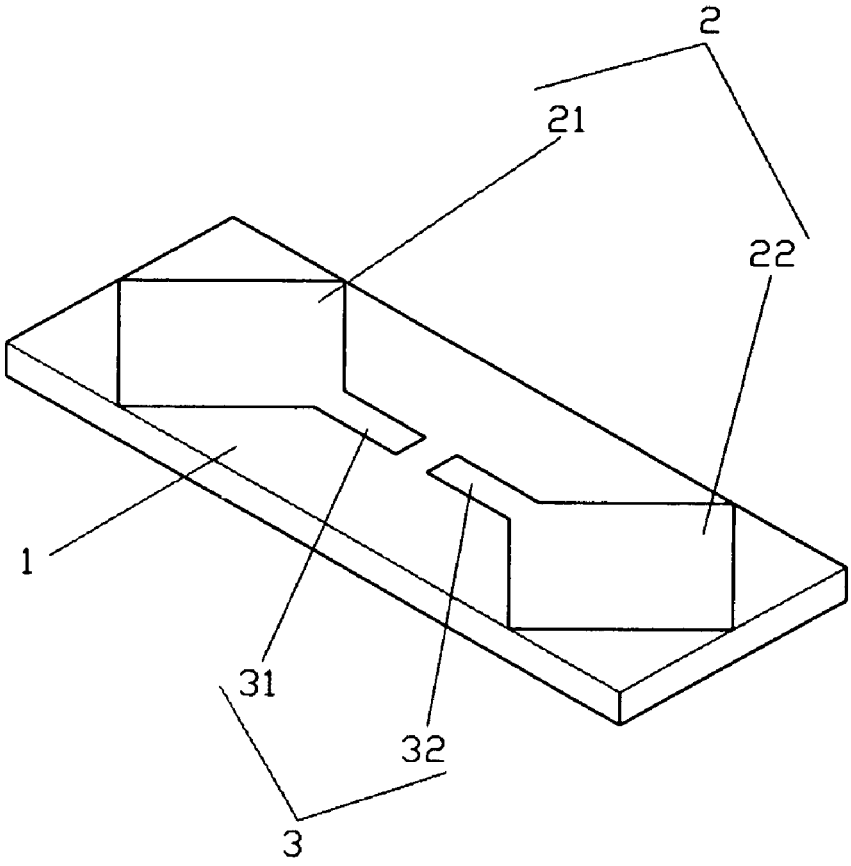
FIG. 7 shows a geometric structure of a single-frequency rhombic dipole antenna.

FIG. 7 shows a single-frequency rhombic dipole antenna structure including a substrate 1 formed on a FR-4 board with a relative dielectric constant $\in_r$=4.4, a loss tangent of 0.0245, a thickness of 0.8 mm and an area of 41 mm×15 mm. The structure comprises the following elements.

A radiation portion 2 is printed on the substrate 1 and includes a first radiator 21 and a second radiator 22 arranged with an interval in between, and the first radiator 21 and the second radiator 22 are rhombic metal plates, and a near end and a corresponding far end are disposed at the first radiator 21 and the second radiator 22 respectively.

The feed-in portion 3 comes with corresponding upper and lower sides and includes a first linear section 31 and a second linear section 32. The first linear section 31 is extended from an end adjacent to the first radiator 21 towards the second radiator 22, and the second linear section 32 is extended from an end adjacent to the second radiator 22 towards the first radiator 21. An interval is reserved between the first linear section 31 and the second linear section 32. The feed-in portion 3 has a signal feed-in line with a width of 2 mm for feeding 50 ohms.

Figure 8:
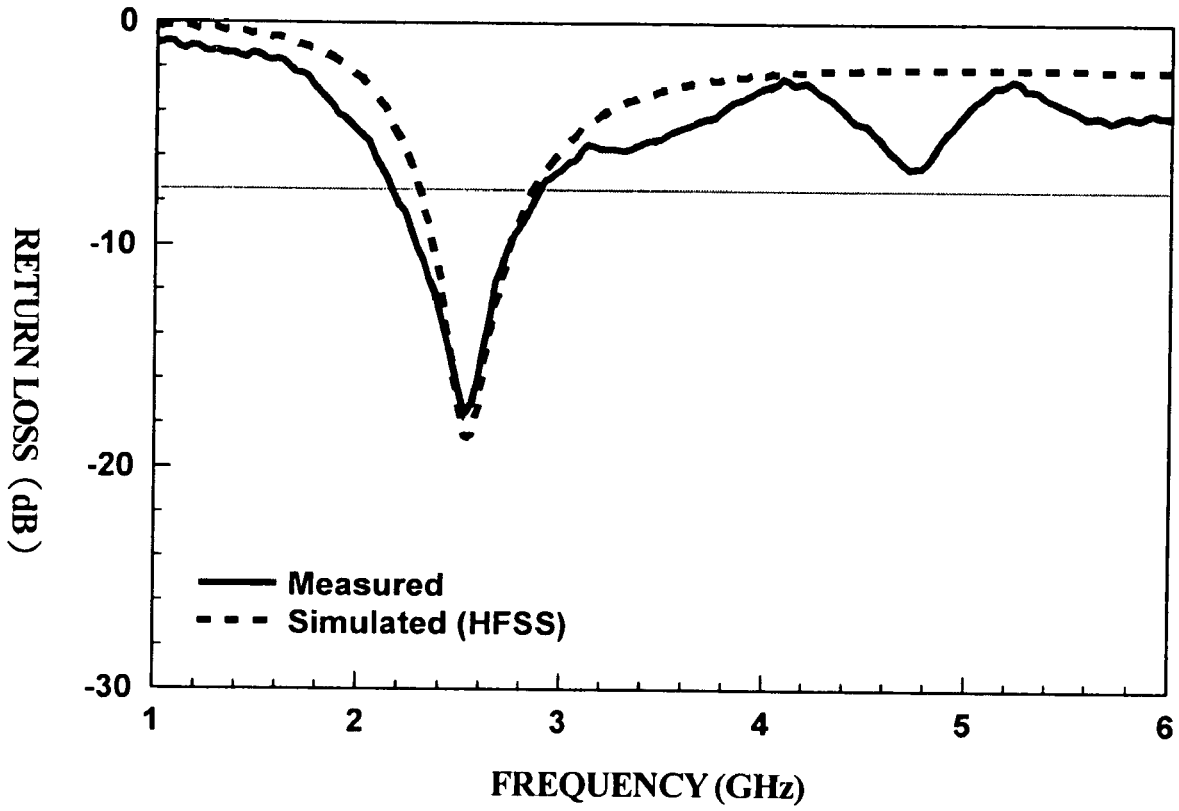
FIG. 8 shows a graph of experiment results of return loss versus frequency of a single-frequency rhombic dipole antenna.
Figure 9A:
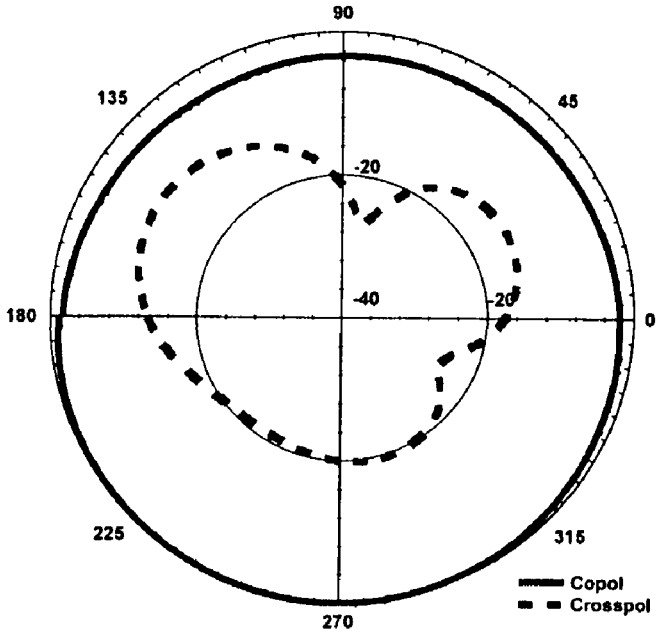
FIG. 9(*a*) shows a 2.5 GHz radiation field on Plane X-Y of a single-frequency rhombic dipole antenna.
Figure 9B:
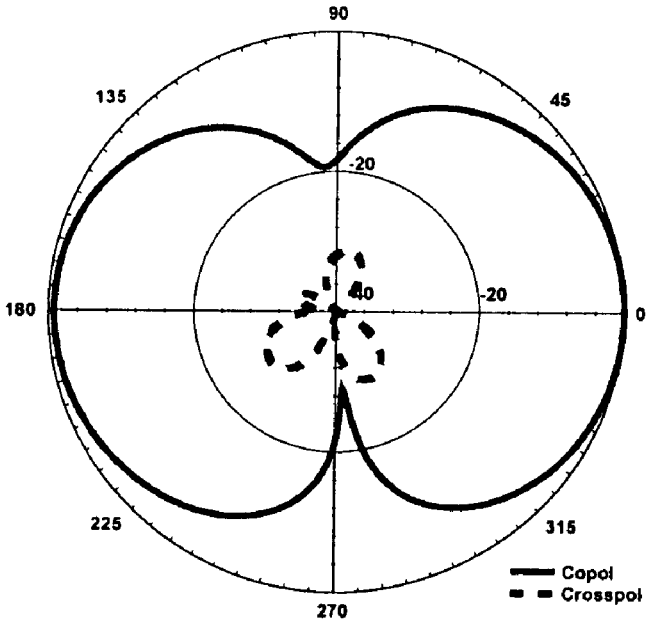

FIG. 8 shows the return loss of the single-frequency rhombic dipole antenna, and both actual practice and simulation give a very good verification. If the frequency covers 2.13~2.88 GHz as shown in FIGS. 9*a* and 9*b*, and the operating frequency is 2.5 GH, the measured experiment results of co-polarization and cross-polarization far-field radiation fields on Plane X-Y and Plane Y-Z are shown.

Figure 10:
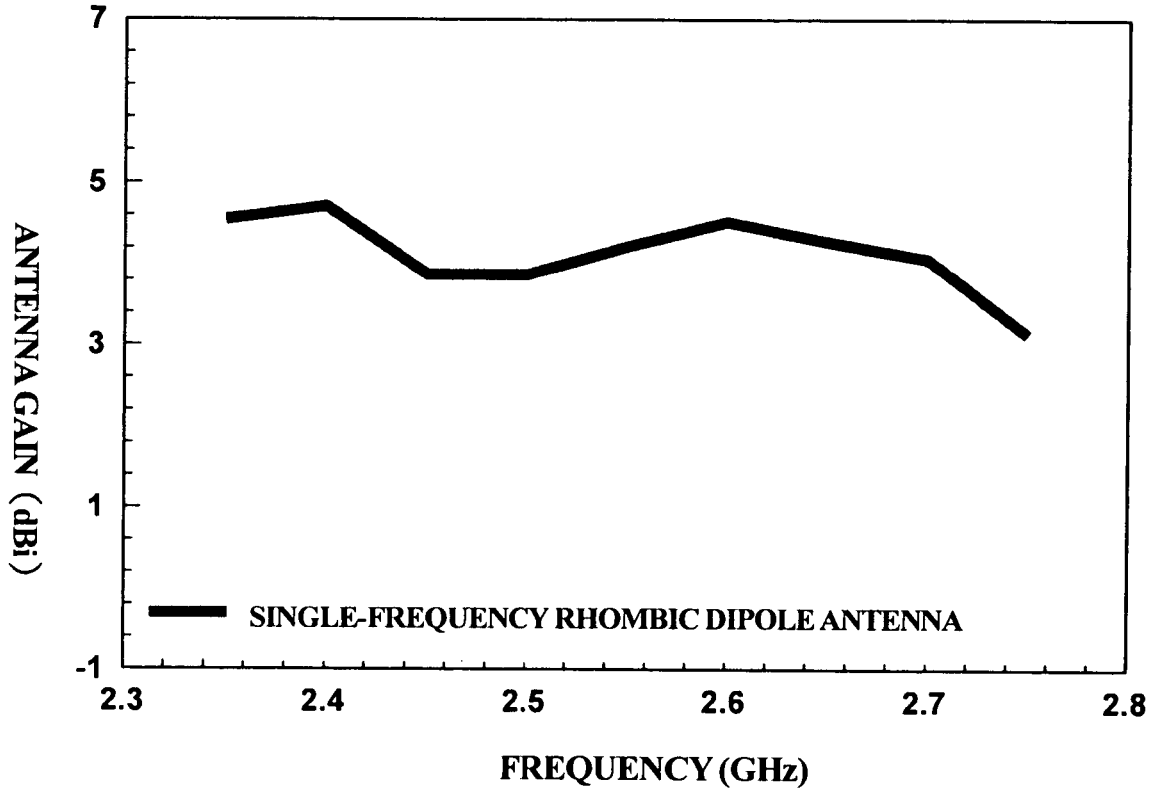
FIG. 10 shows a graph of the antenna gain versus the frequency of a single-frequency rhombic dipole antenna.

Referring to FIG. 10 for a graph of antenna gain versus frequency, the maximum gain 4.51 dBi in this frequency range occurs at 2.6 GHz.

Figure 11:
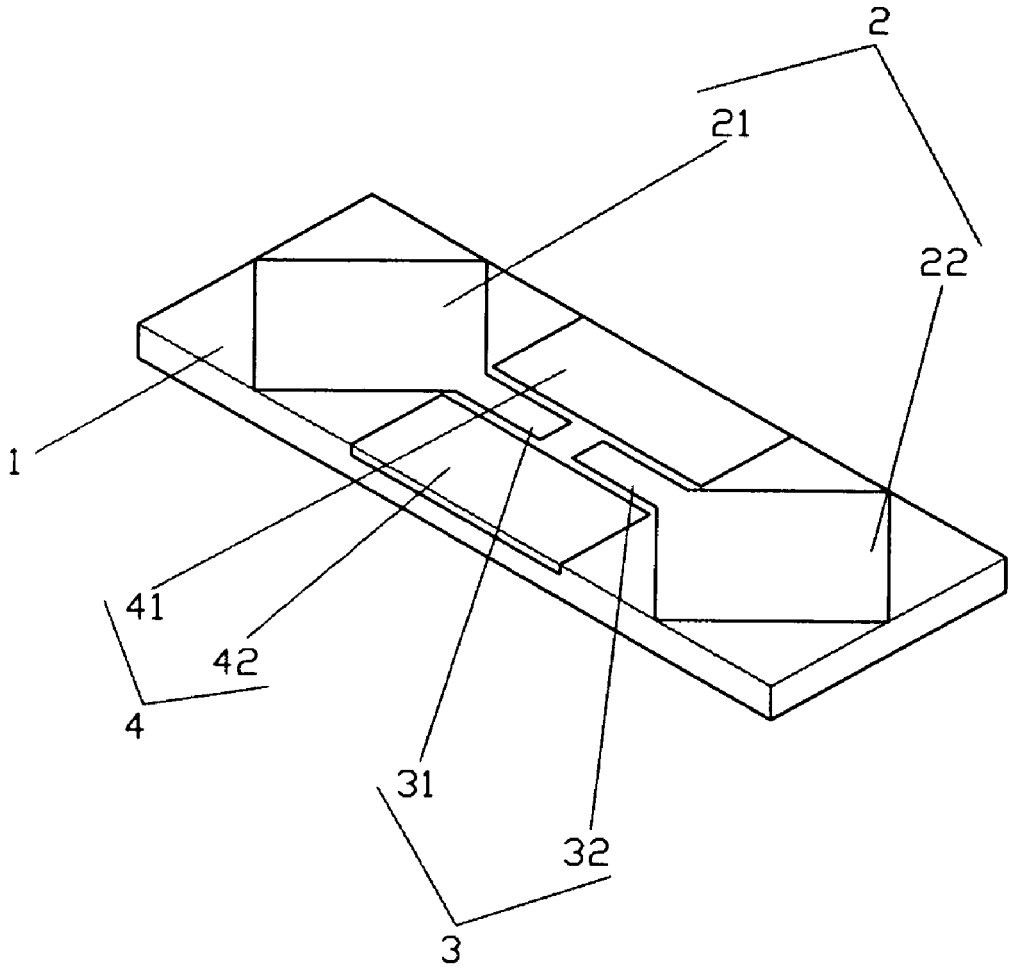
FIG. 11 shows a geometric structure of a single-frequency rhombic dipole antenna including a bandwidth modulation portion.

In FIG. 11, a bandwidth modulation portion 4 installed in the single-frequency rhombic dipole antenna structure includes a first modulation metal plate 41 and a second modulation metal plate 42, both in a rectangular shape, and symmetrically disposed at upper and lower sides of the feed-in portion 3 respectively. The first modulation metal plate 41 and the second modulation metal plate 42 are divided into a first side proximate to the first radiator 21, a second side proximate to the feed-in portion 3, a third side and a fourth side corresponding to the first side. The length and width of the first modulation metal plate 41 and the second modulation metal plate 42 are adjusted to effectively increase the impedance bandwidth. With optimal dimensions such as a width of 6 mm, a length of 13 mm, and an interval of 0.5 mm from the feed-in portion 3, the WiMAX dipole antenna for wideband operations is designed successfully.

Figure 12:
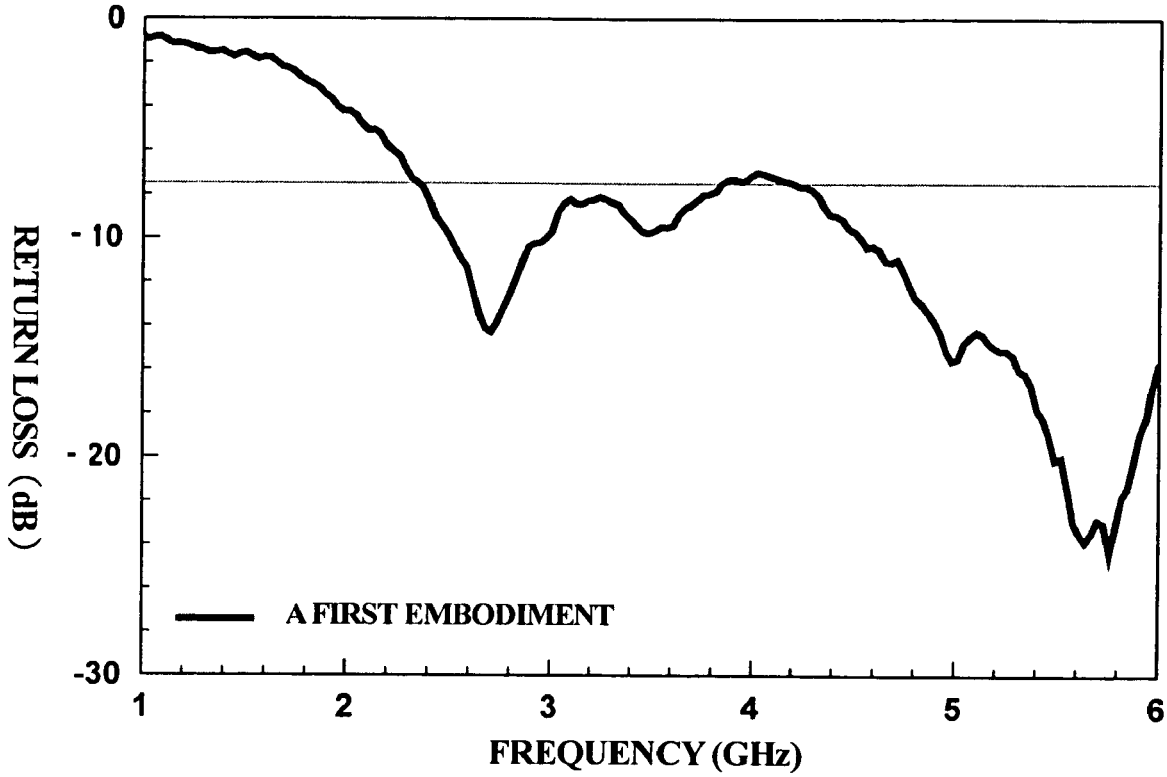
FIG. 12 shows a graph of experiment results of return loss versus frequency of a single-frequency rhombic dipole antenna including a bandwidth modulation portion.

Referring to FIG. 12 for a graph of experiment results of return loss versus frequency of a single-frequency rhombic dipole antenna including a bandwidth modulation portion, the solid line indicates the measured experiment results, and the operating frequency 2.34~6 GHz complies with the operating frequency of WiMAX. With optimization, the return loss is greater than 7.5 dB, and a wideband operation over 2.34~6 GHz is produced, and the bands cover the tri-frequency operating band of WiMAX.

Figure 13:
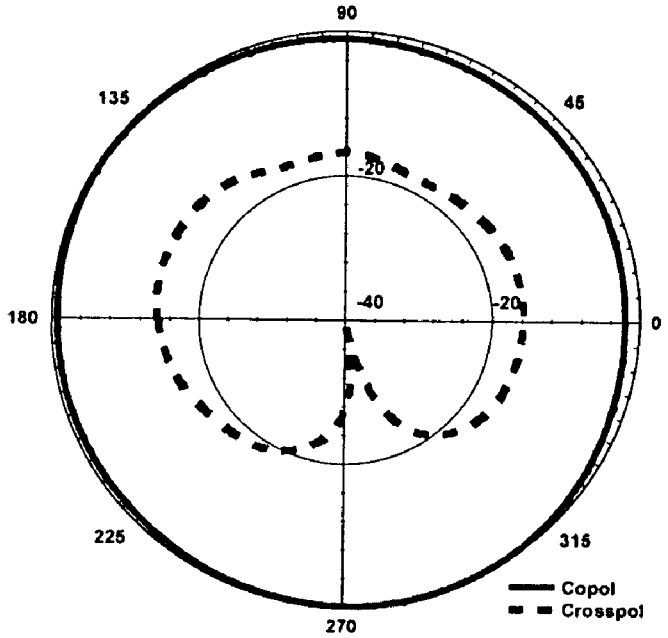
FIG. 13 shows 2.5 GHz radiation fields respectively on Plane X-Y and Plane Y-Z of a single-frequency rhombic dipole antenna including a bandwidth modulation portion.
Figure 13:
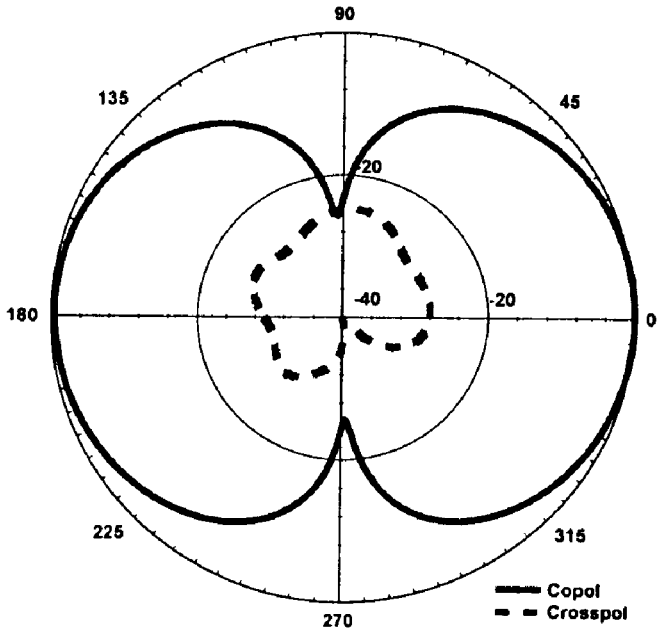
Figure 14:
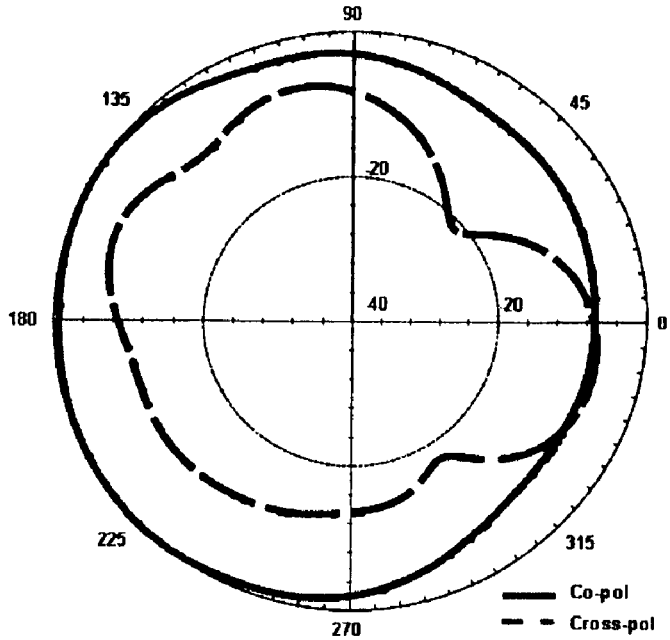
FIG. 14 shows 3.5 GHz radiation fields respectively on Plane X-Y and Plane Y-Z of a single-frequency rhombic dipole antenna including a bandwidth modulation portion.
Figure 14:
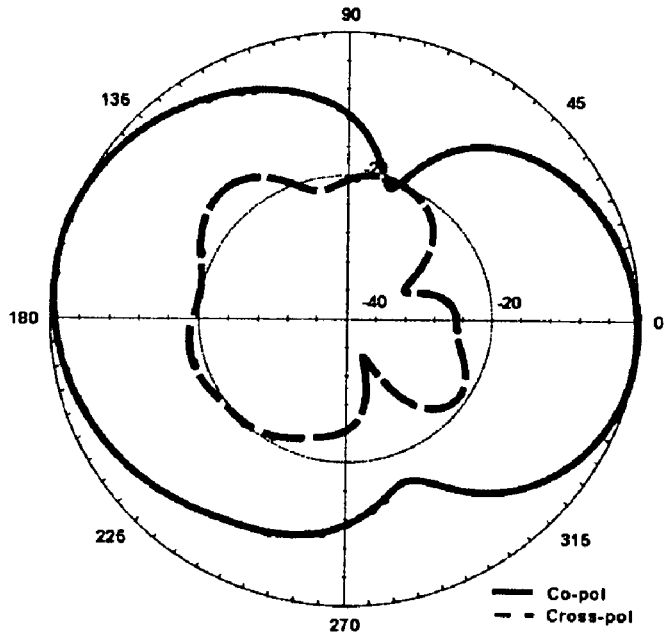
Figure 15:
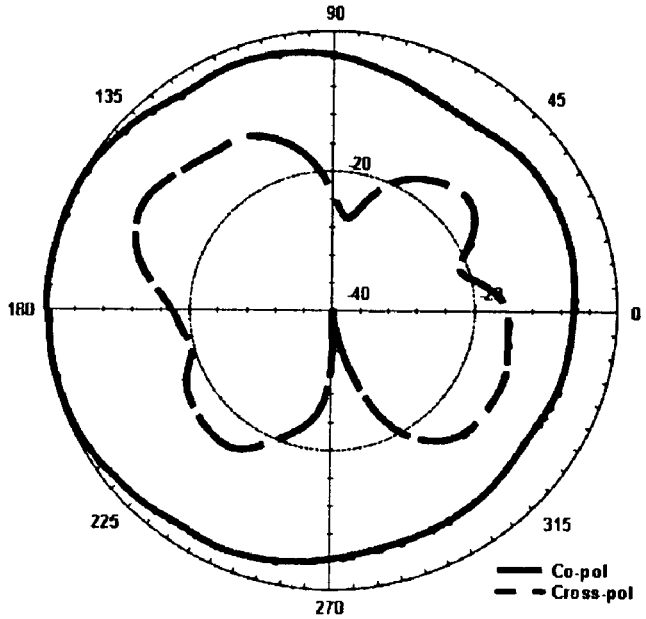
FIG. 15 shows 5.5 GHz radiation fields respectively on Plane X-Y and Plane Y-Z of a single-frequency rhombic dipole antenna including a bandwidth modulation portion.
Figure 15:
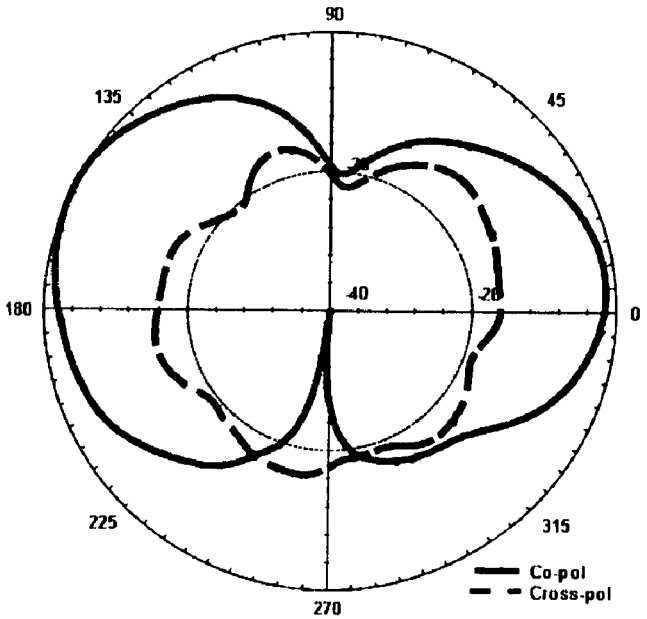

Referring to FIGS. 13 to 15 for the measured experiment results of 2.5 GHz 3.6 GHz and 5.5 GHz radiation fields on Plane X-Y and Plane Y-Z of a single-frequency rhombic dipole 1 antenna including a bandwidth modulation portion respectively, the results of the radiation fields show that the single-frequency rhombic dipole antenna having a bandwidth modulation portion comes with a very good co-polarization radiation, which is the common broadside radiation.

Figure 16:
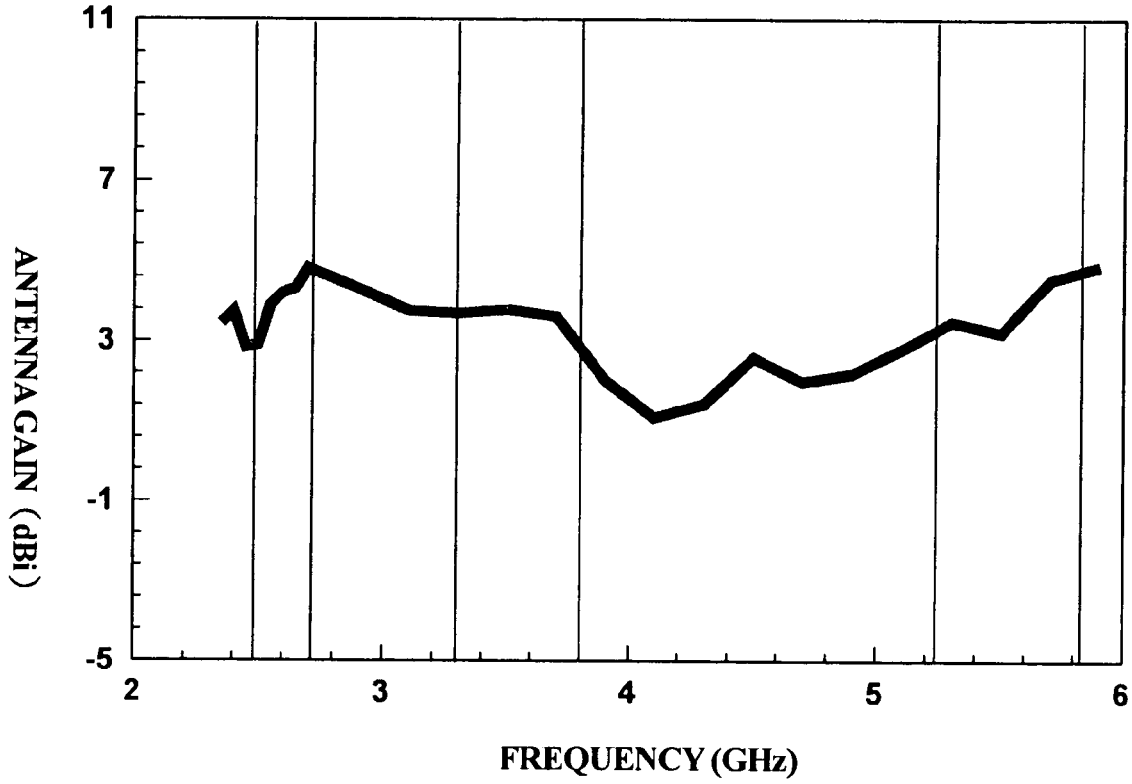
FIG. 16 shows a graph of the antenna gain versus the frequency of a single-frequency rhombic dipole antenna including a bandwidth modulation portion.

Referring to FIG. 16 for a graph of the antenna gain versus the frequency of a single-frequency rhombic dipole antenna including a bandwidth modulation portion, the three frequencies of the antenna are maximum gains 4.81, 3.61 and 4.71 dBi respectively. Besides satisfying the requirement for a high gain of the WiMAX system, the invention also provides a smaller and lighter antenna.

Figure 17:
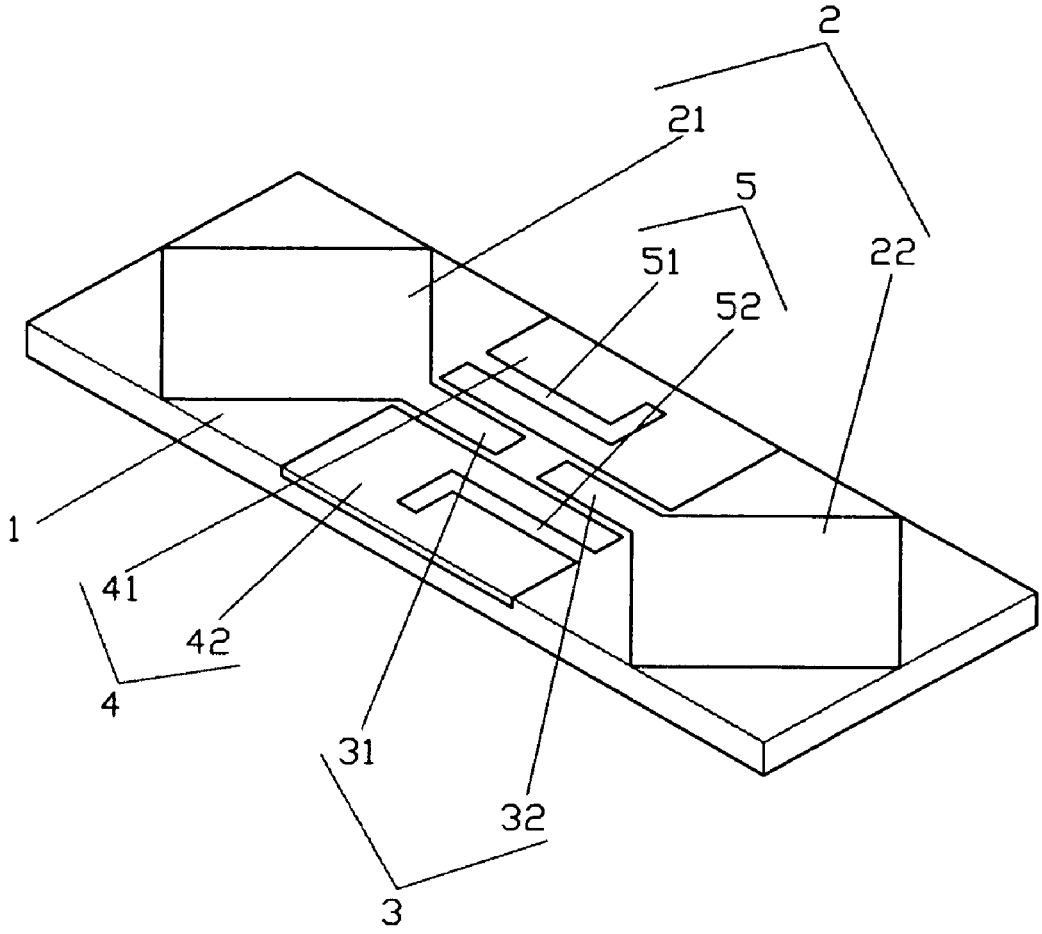
FIG. 17 shows a geometric structure of a single-frequency rhombic dipole antenna including a band reject portion at a bandwidth modulation portion.
Figure 18:
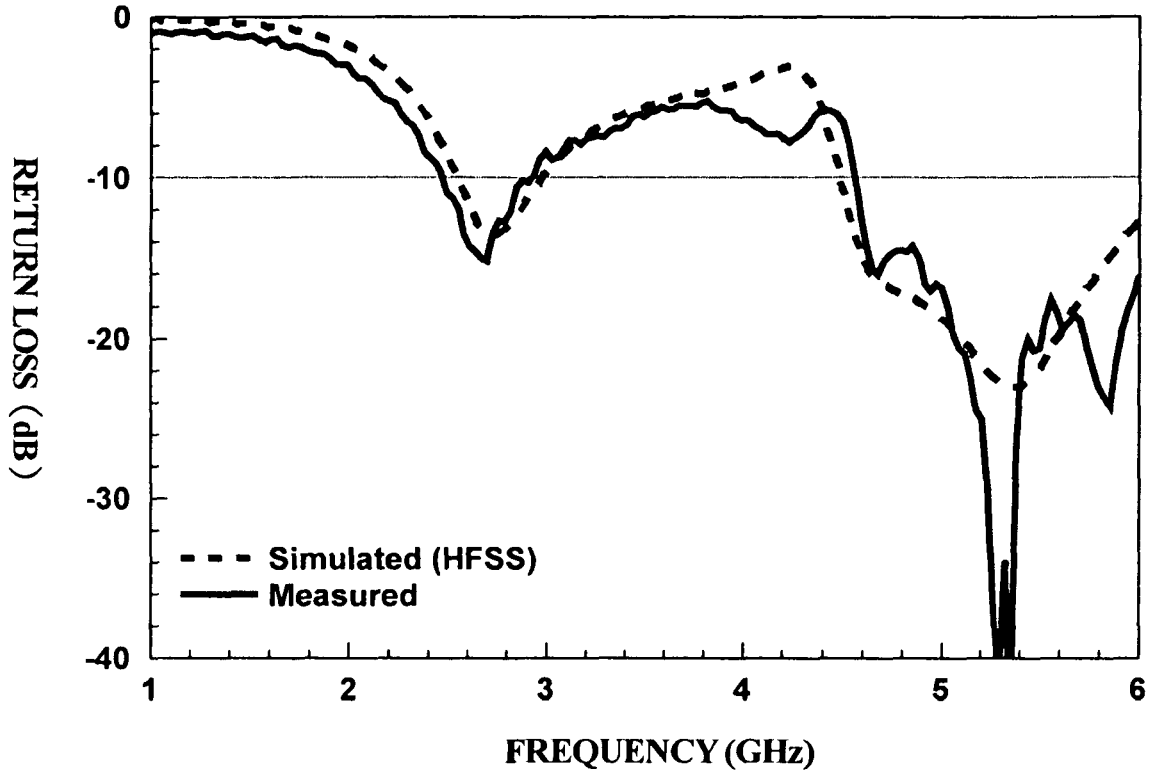
FIG. 18 shows a graph of the experiment results of return loss versus frequency of a single-frequency rhombic dipole antenna including a band reject portion at a bandwidth modulation portion.

Referring to FIG. 17 for a single-frequency rhombic dipole antenna having a bandwidth modulation portion, and the bandwidth modulation portion 4 includes a band reject portion 5, wherein a first band reject 51 and a second band reject 52 are disposed at the first modulation metal plate 41 and the second modulation metal plate 42 respectively, and installed anti-symmetrically. The first band reject 51 is disposed at the first modulation metal plate 41 and a L-shaped slit is extended from an opening of the first side towards the third side, with a closed end disposed towards the fourth side, and the second band reject 52 is disposed at the second modulation metal plate 42, and another L-shaped slit is extended from an opening of the third side towards the first side, with a closed end disposed towards the fourth side, such that the bands not required by WLAN is adjusted to unmatched. A substantially same result is also demonstrated by and matched with the return loss found in actual practices and simulations as shown in FIG. 18.

Figure 19:
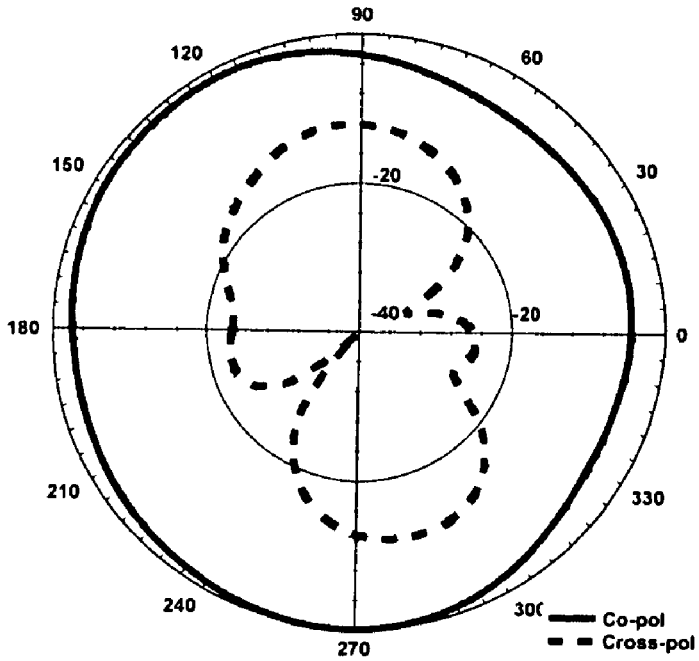
FIG. 19 shows 2.5 GHz radiation fields on Plane X-Y and Plane Y-Z of a single-frequency rhombic dipole antenna including a band reject portion on a bandwidth modulation portion.
Figure 19:
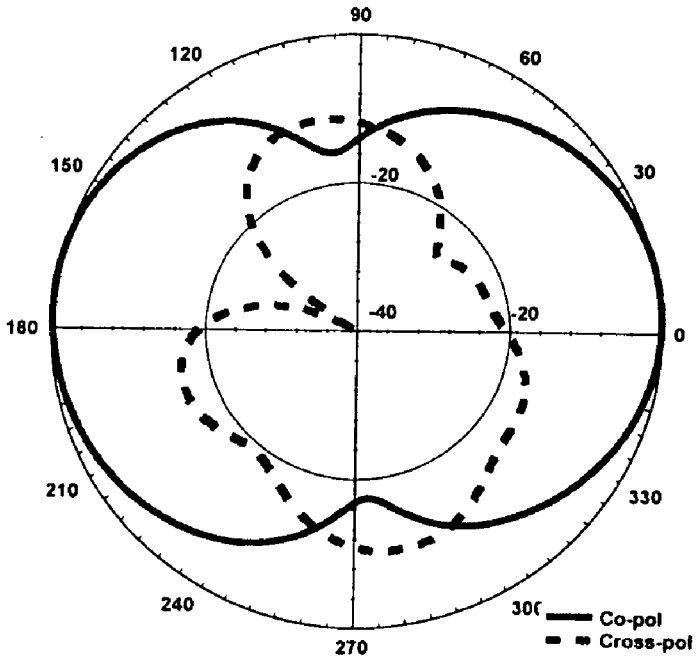
Figure 20:
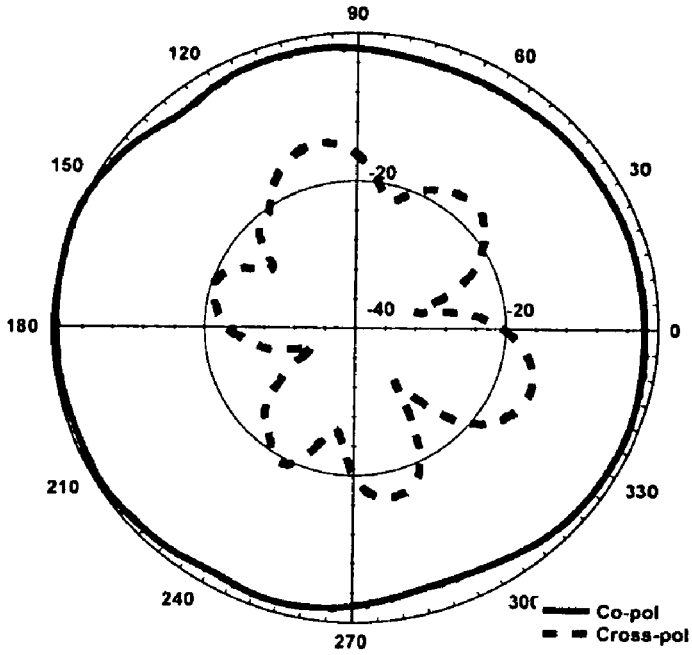
FIG. 20 shows 5.5 GHz radiation fields on Plane X-Y and Plane Y-Z of a single-frequency rhombic dipole antenna including a band reject portion on a bandwidth modulation portion.
Figure 20:
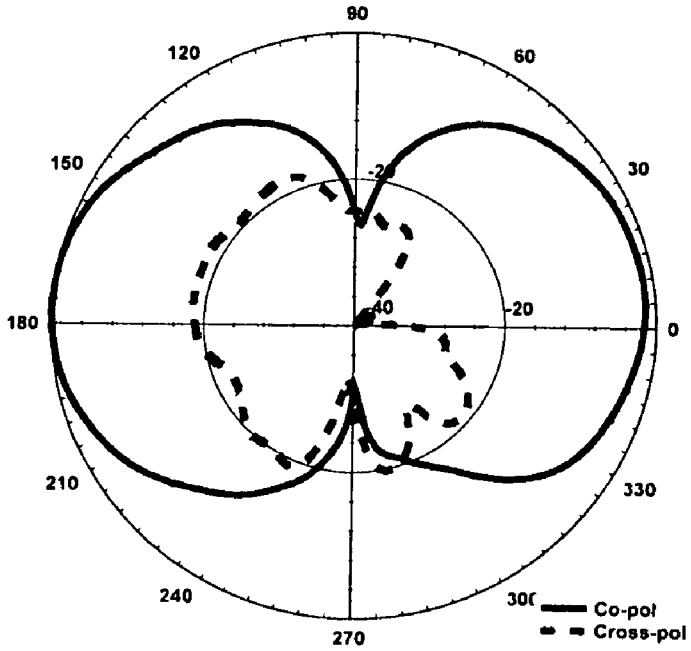

FIGS. 19 and 20 show the measured experiment results of co-planarized and cross planarized far-field radiation field on Plane X-Y and Plane Y-Z of a single-frequency rhombic dipole antenna operated at an operating frequency of 2.5 GHz and 5.5 GHz respectively, the results show that an antenna having a band reject portion 5 features a radiation field with a very good radiation and an isotropic radiation field.

Figure 21A:
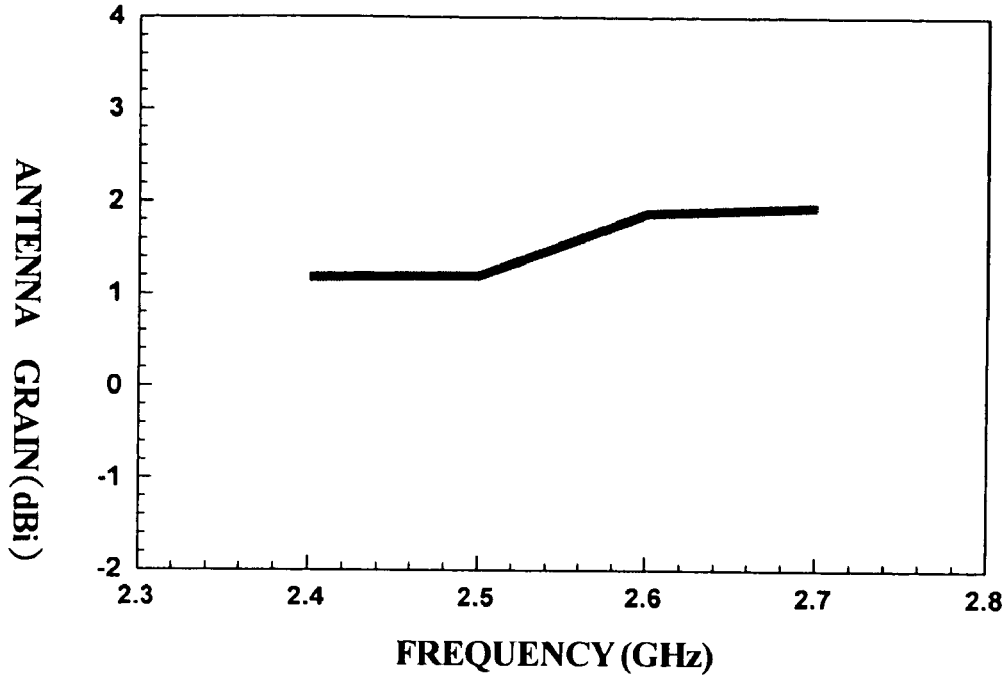
FIG. 21(*a*) shows a graph of the antenna gain versus the frequency of a single-frequency rhombic dipole antenna including a band reject portion on a bandwidth modulation portion at 2.4~2.7 GHz.
Figure 21:
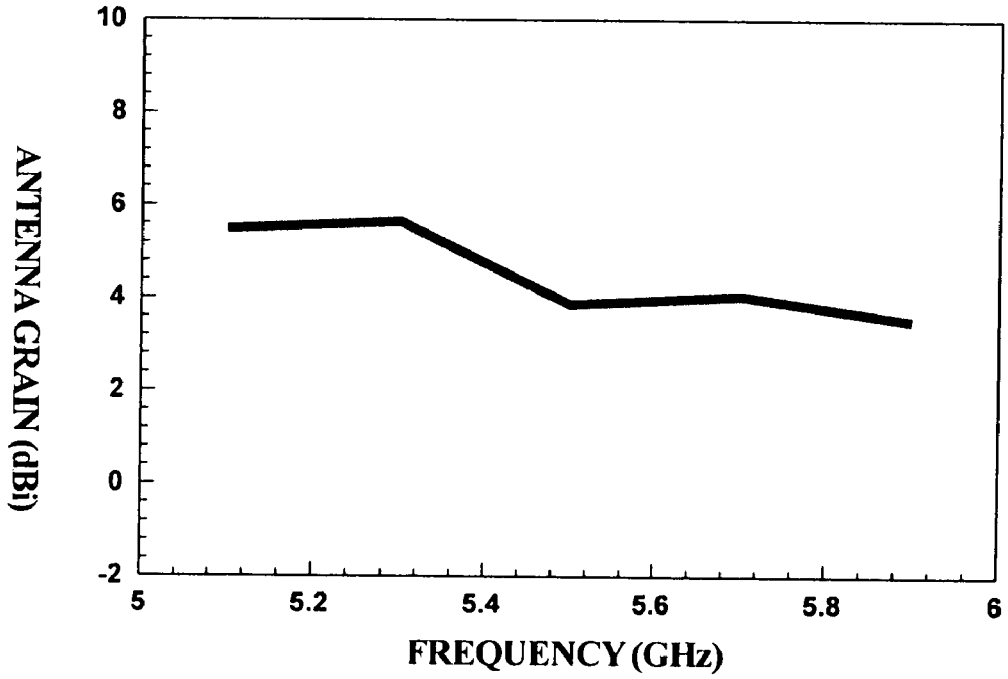

FIGS. 21*a* and 21*b* show graphs of the antenna gains versus the frequencies of a single-frequency rhombic dipole antenna including the band reject portion 5 at two bands 2.4~2.48 GHz and 5.15~5.825 GHz. The graphs show that an antenna with the band reject portion 5 can achieve the required dual-frequency operations and cover the band of 2.4~2.48 GHz for WLAN. For dual-frequency operations, the cost of filters for the circuit design can be saved, and the design simply requires a single anti-symmetrical slit for producing a suppressed band, and the length of the slit can be adjusted to freely shift the two suppressed bands to the high frequency or the low frequency.

Figure 22:
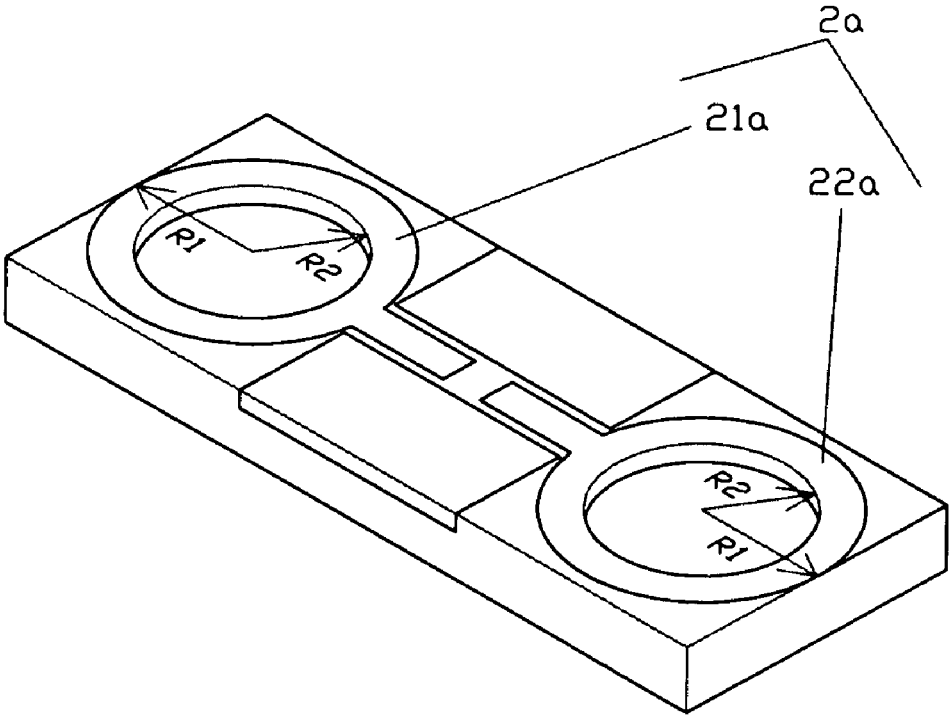
FIG. 22 shows a geometric structure of a wideband circular printed dipole antenna for wireless applications.

FIG. 22 shows a wideband circular printed dipole antenna for wireless applications, and the difference of the structure between this antenna and the aforementioned single-frequency rhombic dipole antenna with a bandwidth modulation portion resides on that a radiation portion 2*a* includes a first radiator 21*a* and a second radiator 22*a* with an interval in between, and the first radiator 21*a* and the second radiator 22*a* are circular metal plates. The first radiator 21*a* and the second radiator 22*a* have corresponding near ends and far ends. In FIG. 22, R1 indicates the external diameter of the first radiator 21*a* and the second radiator 22*a*, and R2 indicates the internal diameter.

Figure 23:
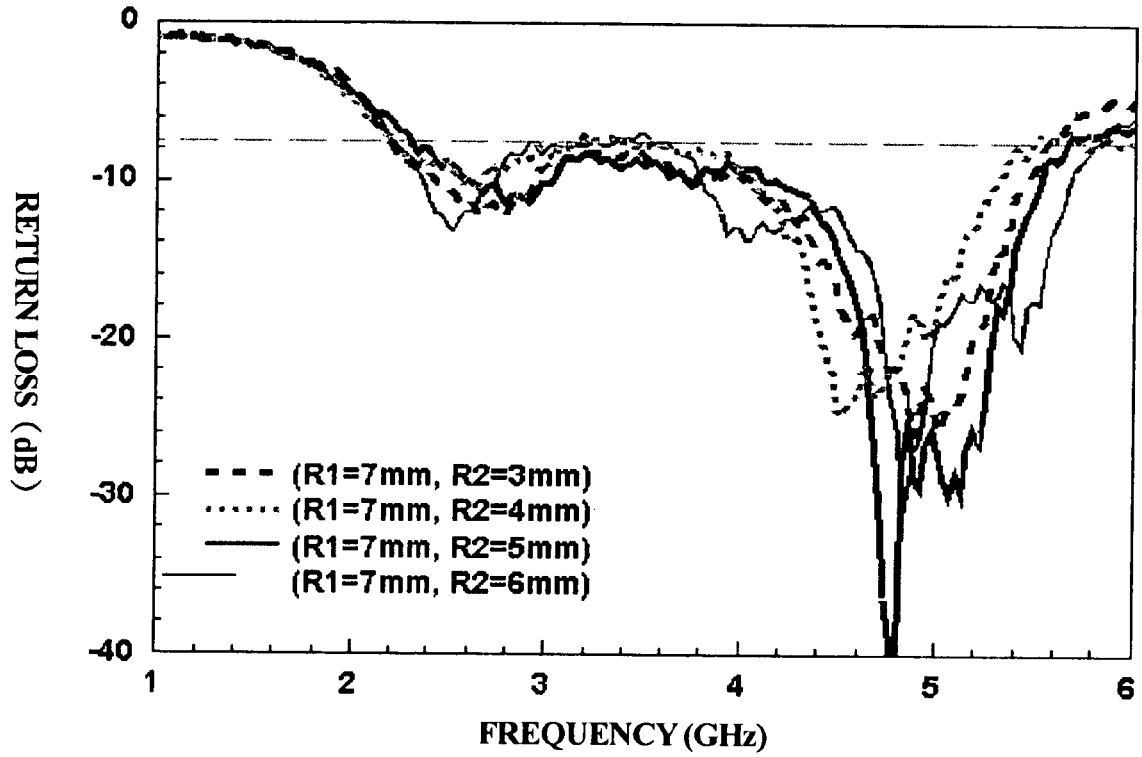
FIG. 23 shows a graph of the return loss versus the frequency if the internal diameter R2 of a circular radiation portion of a wideband circular printed dipole antenna for wireless applications is changed.

In FIG. 23, R1 is a fixed parameter of a wideband circular printed dipole antenna for wireless applications. The larger the parameter R1, the lower is the starting frequency of the wideband operation. If the parameter R2 is adjusted, then the required band can be achieved, since the larger the parameter R2, the higher is the high-frequency cut-off frequency.

Figure 24:
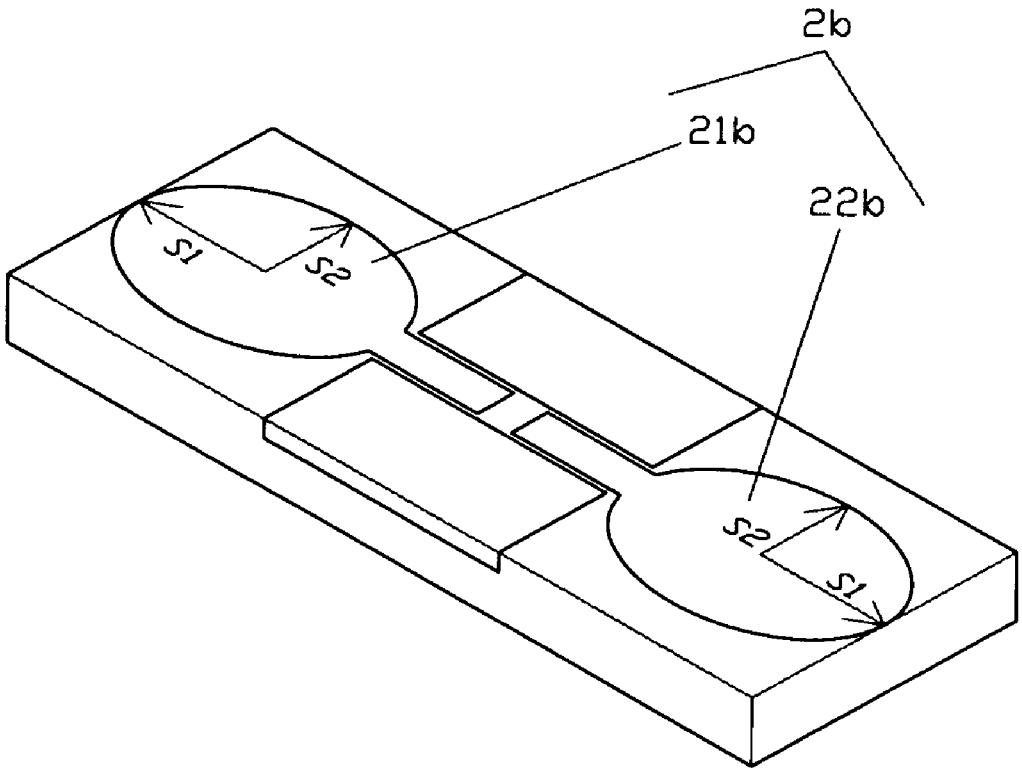
FIG. 24 shows a geometric structure of a preferred embodiment of the present invention.

FIG. 24 shows a wideband printed dipole antenna for wireless applications in accordance with a preferred embodiment of the present invention, the difference between this embodiment with the aforementioned antennas resides on the radiation portion 2*b* of this embodiment includes a first radiator 21*b* and a second radiator 22*b* arranged with an interval in between, and the first radiator 21*b* and the second radiator 22*b* are oval metal plates. The first radiator 21*b* and the second radiator 22*b* have corresponding a near end and a far end respectively. In FIG. 24, S1 indicates the long axis of the first radiator 21*b* and the second radiator 22*b*, and S2 indicates the short axis.

Figure 25:
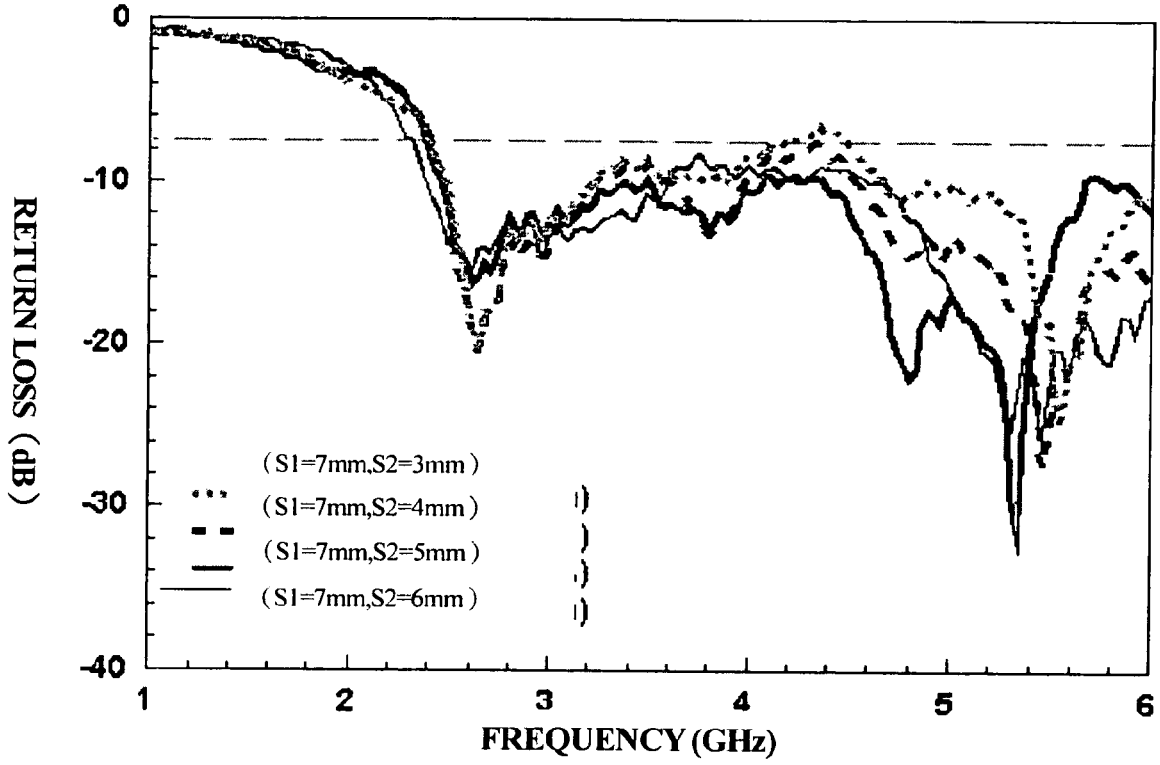
FIG. 25 a graph of the return loss of an oval short axis S2 versus the frequency in accordance with the preferred embodiment of the present invention.

In FIG. 25, if the length of the oval parameter S2 is greater than 2 mm, a good wideband operation can be achieved. Since the printed antenna of the invention has the super thin, lightweight and easy-to-manufacture advantages, the structure is simple and the cost is low. The wideband operation can cover the bands of 2.4~2.48 GHz and 5.15~5.825 GHz for WLAN, and thus the invention provides a good radiation and an isotropical radiation field, and integrates with a radio frequency circuit system easily.

Figure 26:
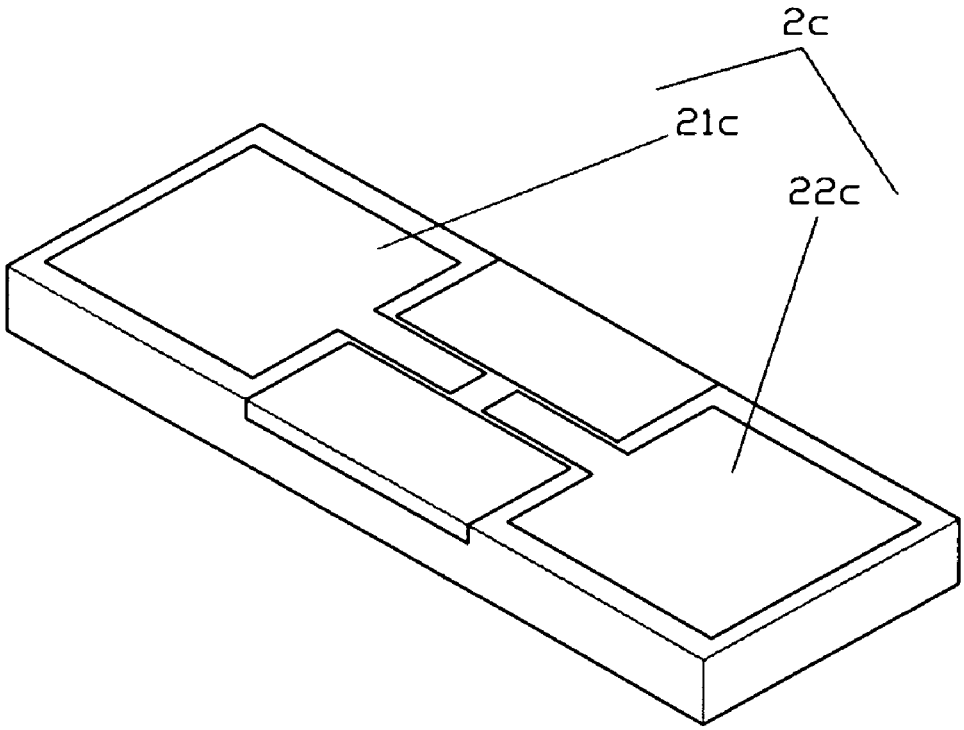
FIG. 26 shows a geometric structure of a wideband rectangular printed dipole antenna for wireless applications.

Referring to FIG. 26 for a wideband rectangular printed dipole antenna for wireless applications, the difference of this embodiment from the first embodiment resides on that the radiation portion 2*c* includes a first radiator 21*c* and a second radiator 22*c* arranged with an interval in between, and the first radiator 21*c* and the second radiator 22*c* are rectangular metal plates or square metal plates (not shown in the figure).

Referring to FIG. 27 for a graph of the return loss versus the frequency of the aforementioned antenna, this antenna gives a better wideband operation than a rectangular dipole antenna without installing a bandwidth modulation portion.

From the embodiments described above, we can see that the design of the wideband printed dipole antenna for wireless applications in accordance with the present invention can be extended to the structures in various shapes, and such design is very helpful. Each embodiment of the invention can be applied to a WiMAX wideband dipole antenna with a small volume of $41\times15\times0.8$ $mm^3$, and the printed antenna has the super thin, lightweight, and easy-to-manufacture advantages. Since the structure is simple, the cost is low. The antenna of the invention can be designed freely for wideband or dual-frequency operations. For dual-frequency operations, the cost of filters for the circuit design can be saved, and the design simply requires a single anti-symmetrical slit for producing a suppressed band, and the length of the slit can be adjusted to freely shift the two suppressed bands to the high frequency or the low frequency, and covers the bands of 2.4~2.48 GHz and 5.15~5.825 GHz for WLAN. The antenna of the invention has a good radiation and an isotropical radiation field for integrating a radio frequency circuit system easily.

While we have shown and described the embodiment in accordance with the present invention, it should be clear to those skilled in the art that further embodiments may be made without departing from the scope of the present invention.

What is claimed is:

1. A wideband printed dipole antenna for wireless applications, with a substrate comprising:

a radiation portion, including a first radiator and a second radiator arranged with an interval in between, and the first and second radiators being oval metal plates;

a feed-in portion, having corresponding upper and lower sides in a long bar shape, and including a first linear section and a second linear section, and the first linear section being extended from the first radiator towards the second radiator, and the second linear section being extended from the second radiator towards the first radiator, and an interval being formed between the first and second linear sections; and a bandwidth modulation portion, including a first modulation metal plate and a second modulation metal plate, symmetrically disposed at the upper and lower sides of the feed-in portion.

2. The wideband printed dipole antenna for wireless applications as claimed in claim 1, wherein the bandwidth modulation portion includes a first band reject disposed on the first modulation metal plate and a second band reject disposed on the second modulation metal plate.

3. The wideband printed dipole antenna for wireless applications as claimed in claim 2, wherein the first and second band rejects are disposed anti-symmetrically with each other, and the first modulation metal plate and the second modulation metal plate disposed in the bandwidth modulation portion are divided into a first side proximate to the first radiator, a second side proximate to the feed-in portion, a third side and a fourth side corresponding to the first side, and the first band reject disposed at the first modulation metal plate includes a L-shaped slit extended from an opening of the first side towards the third side and with a closed end of the first side disposed in a direction towards the fourth side, and the second band reject is disposed at the second modulation metal plate, and an opening of the third side extended towards the first side includes another L-shaped slit, and with a closed end disposed towards the fourth side.

4. The wideband printed dipole antenna for wireless applications as claimed in claim 1, wherein the wideband printed dipole antenna is printed on a FR-4 board with a relative dielectric constant $\in_r=4.4$ and a loss tangent of 0.0245.

5. The wideband printed dipole antenna for wireless applications as claimed in claim 1, wherein the feed-in portion has a microstrip of 50 ohms.

6. The wideband printed dipole antenna for wireless applications as claimed in claim 1, wherein the first and second modulation metal plates are rectangular in shape.

* * * * *